United States Patent [19]

Ku et al.

[11] 4,037,707

[45] July 26, 1977

[54] CUP SHAPED PRINTER

[75] Inventors: Ta Cheng Ku; Donald Joseph Stiles, both of Endwell, N.Y.

[73] Assignee: International Business Machines Corporation, Armonk, N.Y.

[21] Appl. No.: 665,030

[22] Filed: Mar. 8, 1976

[51] Int. Cl.[2] ..... B41J 1/34

[52] U.S. Cl. ..... 197/53; 197/49

[58] Field of Search ..... 101/93.13–93.18, 101/111; 178/34; 197/16, 18, 49, 53, 54

[56] References Cited

U.S. PATENT DOCUMENTS

| | | | |
|---|---|---|---|
| 317,371 | 5/1885 | Kaley | 197/54 |
| 574,230 | 12/1896 | Urbanus | 197/53 |
| 720,573 | 2/1903 | Embald | 197/18 X |
| 2,127,507 | 8/1938 | Fuchs | 197/53 |
| 3,157,264 | 11/1964 | Frechette | 197/16 |
| 3,537,563 | 11/1970 | Stantchev | 197/53 X |
| 3,651,915 | 3/1972 | Folkens | 197/53 |
| 3,651,916 | 3/1972 | Becchi | 197/18 X |

*Primary Examiner*—Edgar S. Burr
*Assistant Examiner*—Paul T. Sewell
*Attorney, Agent, or Firm*—Elmer W. Galbi

[57] ABSTRACT

A serial printer which includes a print element which traverses back and forth in front of the paper. The print element is in the shape of a cup. The sides of the cup are formed by a plurality of fingers, each of which has a number of characters thereon. A hammer is located in the center of the cup. The fingers can be selectively raised whereby any one of the characters on each finger can be moved to the print position. Printing is accomplished by rotating the cup so that the desired finger is located between the hammer and the paper. If necessary, the finger is raised so that the desired character is positioned in the print position. The hammer is then fired to print the desired character.

3 Claims, 5 Drawing Figures

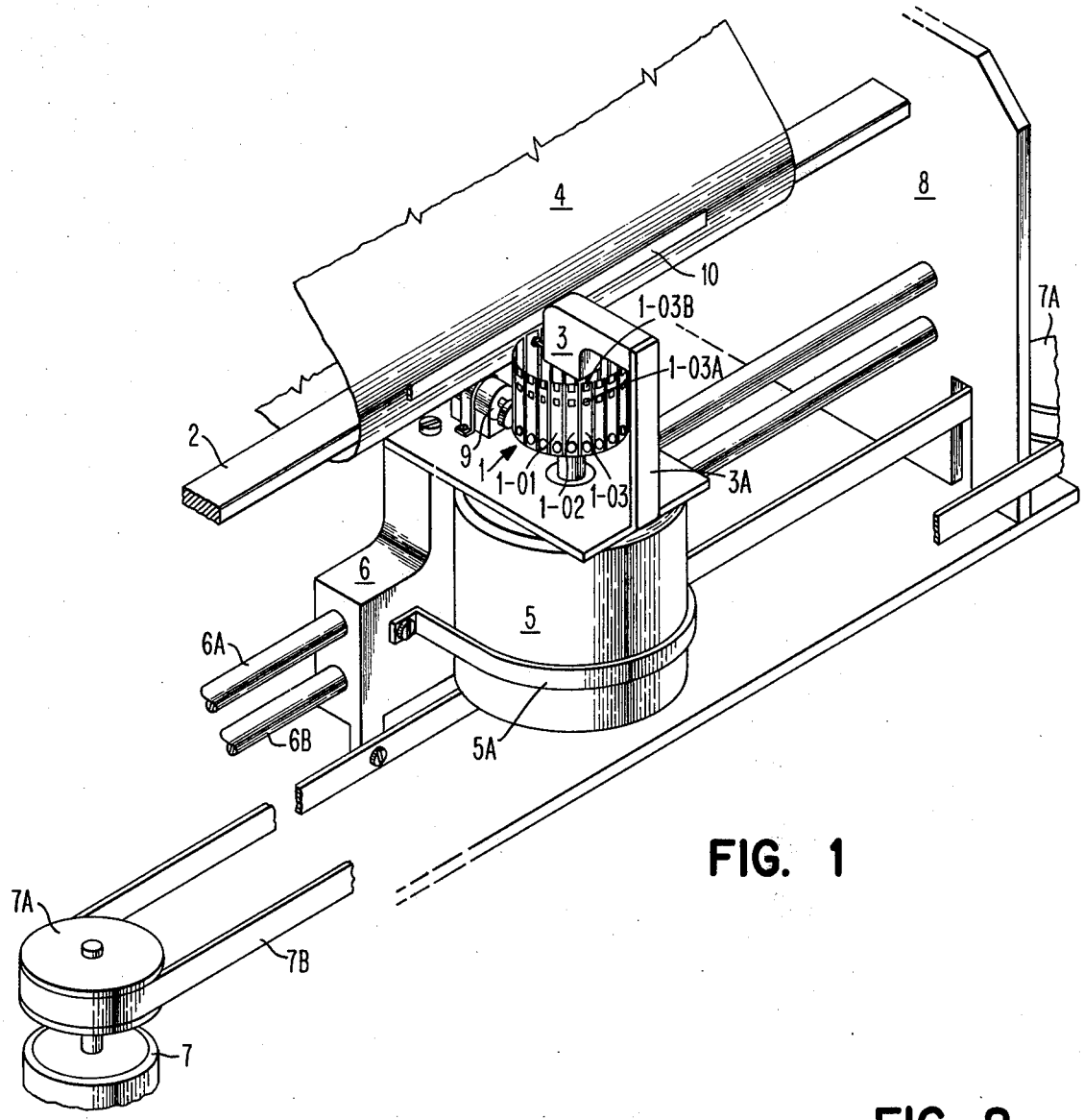
FIG. 1
FIG. 2
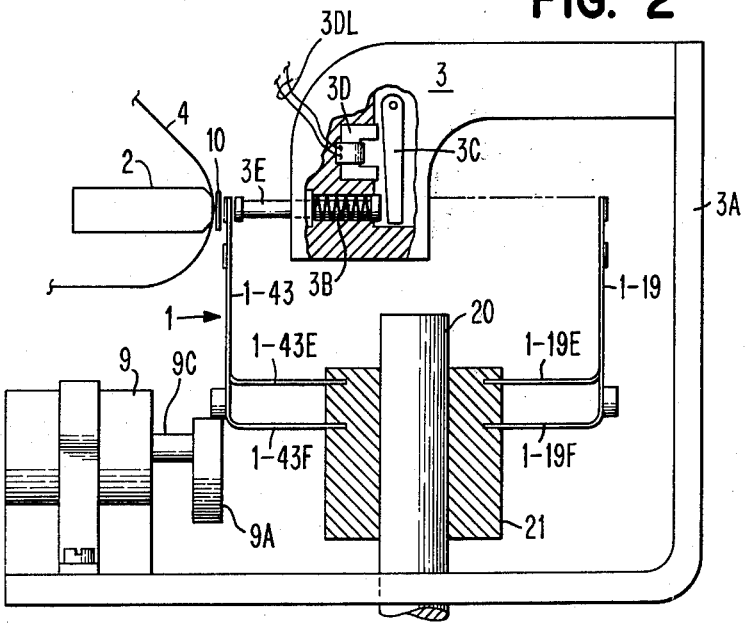
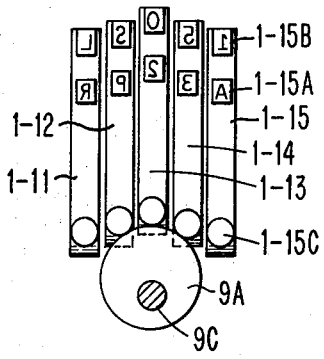
FIG. 3

CUP SHAPED PRINTER

BACKGROUND OF THE INVENTION

1. Field of the Invention

This invention relates to printers, and more aparticularly to serial printers which include a rotatable print element.

2. Description of the Prior Art

Serial printers which include a print element in the shape of disk or cup are known in the art. In general, such printers can be divided into two types. In the first type, the print element is constantly rotating and printing takes place on the fly. In the second type, the print element stops and starts and printing takes place while the print element is stationery.

An example of serial printer with a constantly rotating print element can be found in U.S. Pat. No. 3,461,235 (Wilcox), and a serial printer with a print element that stops before printing occurs is shown in U.S. Pat. No. 3,707,214 (Panzo).

Serial printers where the print element is in the shape of a cup are also known. For example, U.S. Pat. No. 3,651,916 (Becchi) shows at FIG. 3 a print element with a rotatable print element in the shape of a cup. The cup has two rows of characters around it perihpery and the entire cup is raised and lowered to select between the rows of characters. It is specifically noted that the fingers on the print element shown in this patent cannot be individually raised and lowered.

A publication in the Elelctronic Magazine, dated June 26, 1975, page 17E, also shows a printer with a cup-like element wherein each finger has a plurality of characters thereon. The entire cup shown in this reference is raised and lowered to select different characters. (It is noted that applicant's date of invention precedes the date of this publication.)

United Kingdom Pat. No. 1,190,506 also shows a rotatable print element which has several rows of characters. The entire print element is raised and lowered to select between the rows of characters. It is noted that the print element in this patent does not include fingers which can be individually raised and lowered.

OBJECTS OF THE PRESENT INVENTION

An object of the present invention is to provide an improved high speed serial printer.

Another object of the present invention is to provide a low cost serial printer.

Still another object of the present invention is to provide a printer which has a high degree of reliability.

A further object of the present invention is to provide a serial printer which requires little maintenance.

Yet another object is to provide a print element that can be shifted between sets of characters with a small amount of energy.

SUMMARY OF THE INVENTION

The foregoing and other objects and advantages are achieved by providing a cup shaped print element wherein the sides of the cup consist of independent finger-like elements. Each finger has a plurality of characters thereon. Means are provided to selectively raise and lower the fingers so that a hammer which is located in the center of the cup can be made to strike any one of the characters located on a finger.

Since the fingers can be independently raised and lowered, only a small amount of energy is required to shift between the upper and the lower character on each finger and such motion can take place very quickly. Furthermore, by using a cam to raise and lower the fingers, at least part of the energy needed to raise and lower the fingers can be provided by the motor which rotates the cup.

Each of the fingers which forms the cup-like print element is supported by two parallel bars. In this way, each finger can be independently raised without substantially tilting the axis of the finger. It is noted that if the axis of the finger were moved, the printing would not be uniform.

Thr foregoing and other objects, features and advantages of the invention will be aparent from the following more particular description of preferred embodiments of the invention, as ilustrated in the accompanying drawing.

BRIEF DESCRIPTION OF THE DRAWING

FIG. 1 shows an overall view of the first embodiment.

FIG. 2 shows the construction of the print element in detail.

FIG. 3 shows how the fingers are selectively raised and lowered.

DESCRIPTION OF THE PREFERRED EMBODIMENTS

Figure 4:
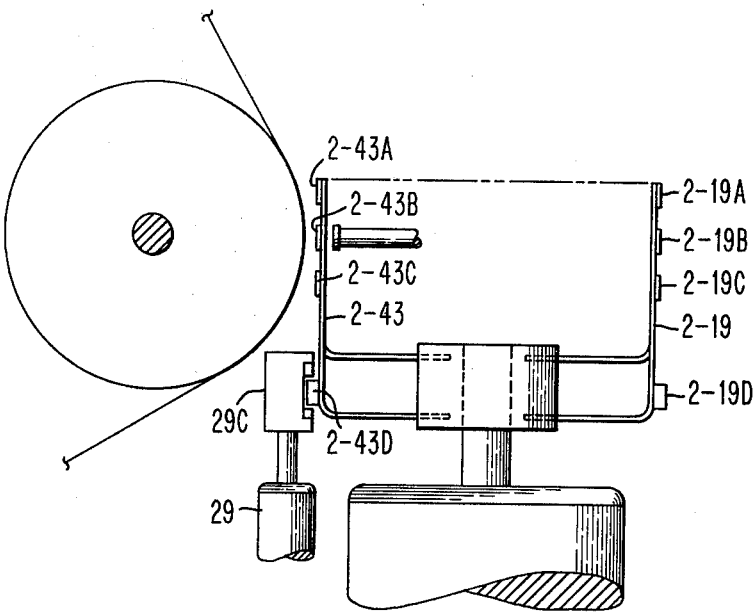
FIGS. 4 and 5 show a second embodiment of the invention.

An overall view of the major elements of the printer is shown in FIG. 1. The printer includes a print element 1, a platen 2, and a print hammer 3. A sheet of paper 4 is positioned between the print element 1 and the platen 2. Print element 1 is rotated by motor 5 mounted on a carrier 6 by hand 5A. Carrier 6 is supported by bars 6A and 6B. Carrier 6 is moved by a motor bar 7 and associated pulleys 7A and drive belt 7B. The entire printer is supported by end plates 8 (only one of which is shown). A typewriter ribbon 10 is positioned between print element 1 and paper 4. Hammer 3 is supported by arm 3A which is attached to carrier 6.

Motor 5 selectively rotates print element 1 whereby a selected finger can be positioned beteen hammer 3 and the paper 4. The rotational motion of print element 1 stops before the hammer 3 strikes the finger to print a character. Carrier drive motor 7 moves carrier 6 across the paper 4 at a constant speed through the action of pulleys 7A and belt 7B. The motion of carrier 6 is not stopped when a character is printed.

Print element 1 has forty-eight fingers designated 1-01 to 1-48. (For clarity of illustration, not all of the fingers are shown). Finger 1-03 has characters 1-03A and 1-03B thereon. When a finger is positioned between the print hammer 3 and paper 4, hammer 3 is normally aligned with the top character on that finger. A solenoid 9 can raise a finger (as shown in FIG. 3) so that the hammer can be made to strike the lower character on the finger.

The details of how rotary solenoid 9 raises the fingers are shown in FIG. 3. The rotary solenoid 9 includes an off center cam 9A mounted on a shaft 9C. Five fingers, designated 1-11, 1-12, 1-13, 1-14, aand 1-15 are shown in FIG. 3. Each of these fingers has a lower character and an upper character thereon. For example, finger 1-15 includes characters 1-15A and 1-15B. Each finger has a pin protruding from near its base. For example, the pin on finger 1-15 is designated 1-15C. The cam 9A can engage the pins, such as pin 1-15C, which are located on the bottom of each finger.

When rotary cam 9 is rotated to the position shown in FIG. 3, the finger directly above the cam is raised so that the hammer 3 will strike the bottom character on that finger. For example, FIG. 3 shows finger 1-13 in a raised position. It is noted that the diameter of cam 9 equals the width of three fingers so that when a particular finger is raised the adjacent fingers are also raised slightly. In this way, as print element 1 is rotated, a finger begins to move up when it reaches the position preceding the print position. (As shown in FIG 3, finger 1-13 is in print position.)

When cam 9 is rotated 180° from the position shown in FIG. 3, the fingers are not raised as they are rotated past the end cam and each finger is positioned so that the hammer will strike the topmost character on the finger if the finger is positioned in print position.

Details of how print element 1 and hammer 3 are constructed are shown in FIG. 2. Print element 1 is mounted on shaft 20 which is connected to motor 5. (Motor 5 is not shown in FIG. 2.) The center portion of print element 1 consists of a donut-shaped piece of metal 21 which forms a support block for the fingers. Each finger is independently attached to support block 21. The fingers are not attached to each other. In this way, the fingers can independently move up and down.

Two fingers 1-43 and 1-19 are shown in FIG. 2. These are representive of each other fingers on print element 1. Each finger is attached to support block 21 by two parallel semi-flexible steel bars. The parallel bars supporting finger 1-43 are designated 1-43E and 1-43F. The parallel bars supporting finger 1-19 are designated 1-19E and 1-19F. One end of each of the parallel bars is bonded into a hole in support block 21 by means of epoxy glue. The other end of each parallel bar is welded to the vertical portion of the finger. When solenoid 9 is rotated to lift a finger, the vertical portion of the finger moves straight up in the direction of the axis of the finger, the spacing between the hammer and the finger between the finger and the platen is changed sightly; however; the axis of the finger remains substantially vertical. It is noted that if the axis did not remain susbtanitally vertical, printing would not be uniform between the top and bottom rows of characters.

Since only a finger is moved into print position when one shifts between rows of characters (as constrasted to moving the entire cup), the amount of energy required to shift between the upper and lower position is very low, therby making it possible to shift more quickly.

The hammer mechanism 3 is a conventional ballistic hammer mechanism. As shown in FIG. 2, it consists of a ballistic element 3E, a restoring spring 3B, a pivoted arm 3C, and an electromagnet 3D. When electromagnet 3D is energized by signal on line 3DL, arm 3C hits element 3E which moves foward and pushes the character (for example, character 1-42A) into the paper.

For clarity and ease of illustration, the support and drive mechanism for ribbon 10 is not shown. It can be a conventional ribbon drive. It merely need position ribbon 10 between print element 1 and paper 4. Alternatively, an ink roll could be positioned to engage the print element 1 so that no ribbon or ribbon drive mechanism would be required.

The carrier 6 and carrier drive are conventional, hence, they are not shown in detail. The carrier drive could be a toothed belt such as, for example, that shown in U.S. Pat. No. 3,882,988. Alternatively, it could be a conventional worm gear drive. The carrier drive merely needs to move the carrier across the paper at a constant speed.

The following is a specific example of how a speed of 60 characters per second can be achieved with the mechanism described herein. Printing at 60 characters per second with a pitch of 10 characters per inch, the carrier would travel at a constant speed of 6 inches per second. Any one of the wide variety of commerically available motors could be used to drive carrier 6 at this speed. As previously described, the 96 separate characters in the character set are positioned on 48 fingers. The maximum distance that the print element rotates between print positions in 180°, since it can rotate in either direction. For a speed of 60 cycles per second, one must be able to position the print element in 16.6 milliseconds. This includes initiating movement, traveling at the maximum speed and decelerating to zero so that printing can take place with the print element 1 stopped. Commercially available motors such as Mirco Switch DC servo motor 33VM 62-000-1 could move print element 1 108° in 12.6 milliseconds, (16.6 milliseconds minus 4 miliseconds for hammer operation) thereby achieving a speed of 60 characters per second. It is noted that utilizing a somewhat more powerful motor 5 to drive the type element 1, could achieve a speed of 85 characters per second. Such a speed would require positioning the print element 1 in a maximum of 8.76 milliseconds (11.76 milliseconds minus 3 milliseconds for hammer operation).

The circuitry for driving motors 5 and 7, rotary solenoid 9, and print hammer 3, is not shown herein since such circuitry could be conventional commercially available circuitry. For example, the drive circuitry shown in copending U.S. patent application Ser. No. 646130, filed Jan. 2, 1975, could be used to drive the carrier 6. The rotary solenoid 9 could be replaced by conventional DC servomechanism or a conventional stepper motor.

As shown herein, the print hammer 3 is located in the center of print element 1. Alternatively, one could build motor 5 in the shape of a donut and have the hammer mechanism supported on the bottom of the motor and extending up through the hole in the center of the motor.

Figure 5:
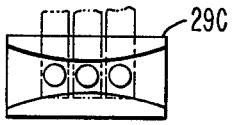

A second embodiment of the invention is shown in FIGS. 4 and 5. This embodiment of the invention is identical to the first embodiment with the exception that each finger has three characters thereon and the mechanism for moving the fingers up and down is different. FIG. 4 shows fingers 2-43 and 2-19, each of which has three characters thereon. Finger 2-26 has three characters designated 2-43A, 2-43B, and 2-43C thereon, and Finger 2-19 has three characters designated 2-19A, 2-19B, and 2-19C thereon. Finger 2-43 has a pin 2-43D and finger 2-19 has a pin 2-19D. These pins are similar to the pins on the fingers in the first embodiment. In the second embodiment, rotary solenoid 9 has been replaced by a linear solenoid 29 and cam surface 9C has been replaced by a member 29C which has a slot therein, as shown in FIG. 5. Electromagnet 29 can move member 29C either up or down a distance equal to the distance between characters on each finger. The length of element 29C is equal to the width of five fingers. When electromagnet 29 is activated, member 29C moves either up or down therby lifting or lowering the finger energy element 29C. The pins on the fingers slide through the slot member 29. Slot in element 29C can be shaped so that the pins move along the same profile as shown in FIG. 3.

It is noted that the first embodiment could be constructed with more than characters per finger and the second embodiment could be made with only two characters per finger.

While this invention has been particularly shown and described with reference to preferred embodiments thereof, it wil be understood by those skilled in the art that the foregoing and other changes in form and details may be made therein without departing from the spirit and scope of the invention.

We claim:

1. A print element for a serial printer which comprises:

a plurality of independent fingers, each of which has an axis and a first and a second end, a plurality of characters on said first end of each finger, a central mounting element, two semi-flexible non-stretchable parallel arms extending from said central mounting element to the second end of each finger, means to independently raise or lower each finger without substantially tilting the axis of said finger.

2. A serial printer comprising:

a platen, a carrier which transverse back and forth along said platen, a cup-shaped rotatable print element mounted on said carrier, said print element having a plurality of independently movable fingers, each finger having a plurality of characters thereon, the chacracters on each finger being spaced along the axis of the finger, a central mounting element, two semi-flexible parallel arms extendidng from said central mounting element to each finger, whereby each finger substantially tilting the axis of said finger, means to select a character for printing by selectively moving a finger in the direction of its axis without moving the entire print element in said direction.

3. A serial printer comprising:

a platen, a carrier which traverses back and forth along said platen, a cup-shaped rotatable print element mounted on said carrier, said print element having a plurality of independently movable fingers, each finger having a plurality of characters thereon, the characters on each finger being spaced along said finger, a central mounting element, two semi-flexible parallel arms extending from said central mounting element to each finger, whereby each finger can be independently raised or lowered without substantially tilting the axis of said finger, means for selectively raising a finger without raising the entire print element, whereby any character on a finger can be selected or printing, and a hammer in the interior of said cup-shaped print element for striking the selected character to effect the printing thereof.

* * * * *